US006484325B1

(12) United States Patent
Lazarus et al.

(10) Patent No.: US 6,484,325 B1
(45) Date of Patent: Nov. 26, 2002

(54) ATHLETIC GARMENT AND EQUIPMENT SYSTEM

(75) Inventors: Mark J. Lazarus, Holland, PA (US); Stephen L. Tacy, Woolwine, VA (US)

(73) Assignee: Liberty Fabrics, Inc., New York, NY (US)

( * ) Notice: Subject to any disclaimer, the term of this patent is extended or adjusted under 35 U.S.C. 154(b) by 0 days.

(21) Appl. No.: 09/470,972

(22) Filed: Dec. 23, 1999

(51) Int. Cl.[7] ..... A41D 27/26

(52) U.S. Cl. ..... 2/462; 2/913; 66/171; 66/195

(58) Field of Search ..... 2/908, 910, 911, 2/909, 913, 455, 459, 461, 462; 66/192, 195, 193, 171

(56) References Cited

U.S. PATENT DOCUMENTS

| | | | | |
|---|---|---|---|---|
| 3,319,307 | A | 5/1967 | Marforio | |
| 3,390,549 | A | 7/1968 | Chandler | |
| 3,943,981 | A | 3/1976 | De Brabander | 139/391 |
| 3,965,944 | A | 6/1976 | Goff, Jr. et al. | 139/421 |
| 3,991,420 | A * | 11/1976 | Savarino | 2/459 |
| T953,009 | I4 | 12/1976 | Neuhaus | 66/195 |
| T962,002 | I4 | 9/1977 | Moore | 66/195 |
| 4,103,485 | A | 8/1978 | Briies | 66/193 |
| 4,441,211 | A * | 4/1984 | Donzis | 2/459 |
| 4,467,625 | A | 8/1984 | Kurz | 66/193 |
| 4,561,123 | A * | 12/1985 | Hull | 2/23 |
| 4,658,604 | A | 4/1987 | Wilson | 66/192 |
| 4,709,562 | A | 12/1987 | Matsuda | 66/193 |
| 4,714,096 | A | 12/1987 | Guay | 139/391 |
| 4,786,549 | A | 11/1988 | Richards | 428/253 |
| 4,838,044 | A | 6/1989 | Matsuda et al. | 66/190 |
| 4,858,447 | A | 8/1989 | Matsuda | 66/191 |
| 4,931,343 | A | 6/1990 | Becker et al. | 428/95 |
| 5,125,246 | A | 6/1992 | Shytles | 66/193 |
| 5,214,942 | A | 6/1993 | Peake, III et al. | 66/194 |
| 5,226,192 | A * | 7/1993 | Jones et al. | 2/461 |
| 5,267,453 | A | 12/1993 | Peake, III et al. | 66/194 |
| 5,373,712 | A | 12/1994 | Yamamoto et al. | 66/195 |
| 5,385,036 | A | 1/1995 | Spillane et al. | 66/87 |
| 5,407,722 | A | 4/1995 | Peake, III et al. | 428/88 |
| 5,449,530 | A | 9/1995 | Peake, III et al. | 427/244 |
| 5,503,892 | A | 4/1996 | Callaway | 428/100 |
| 5,520,021 | A | 5/1996 | Clerici | 66/193 |
| 5,520,022 | A | 5/1996 | Callaway | 66/194 |
| 5,554,239 | A | 9/1996 | Datta et al. | 156/66 |
| 5,615,460 | A | 4/1997 | Weirich et al. | 24/446 |
| 5,616,394 | A | 4/1997 | Gorman et al. | 428/354 |
| 5,664,441 | A | 9/1997 | Clerici | 66/193 |
| 5,699,593 | A | 12/1997 | Jackson | 24/445 |
| 5,736,214 | A | 4/1998 | Billarant | 428/92 |
| 5,742,939 | A * | 4/1998 | Williams | 2/69 |
| 5,771,716 | A | 6/1998 | Schlussel | 66/195 |
| 5,789,058 | A | 8/1998 | Usher et al. | 428/88 |
| 5,806,535 | A | 9/1998 | Becker | 132/54 |
| 5,832,749 | A | 11/1998 | Antonietti | 66/203 |
| 6,041,436 | A * | 3/2000 | Keen | 2/908 |

* cited by examiner

*Primary Examiner*—Danny Worrell
(74) *Attorney, Agent, or Firm*—Kenyon & Kenyon

(57) ABSTRACT

An athletic garment and equipment system according to the present invention includes an athletic garment having at least one section of knitted elastomeric raised loop fabric of a preferred design. The system also includes an athletic pad, pad assembly or other athletic equipment including at least one male hook substrate piece. The section of elastomeric raised loop fabric may be stretched and fixed to the male hood substrate piece to secure the garment to the athletic pad.

24 Claims, 4 Drawing Sheets

ATHLETIC GARMENT AND EQUIPMENT SYSTEM

FIELD OF THE INVENTION

The present invention relates to athletic apparel and equipment, and in particular athletic garments and pads.

BACKGROUND INFORMATION

Many athletic garments are preferably worn fixed to underlying or adjacent equipment such as athletic pads. For example, many football athletes prefer to fix any loose ends of the football jersey so that the jersey is extremely tight around the shoulder or rib pads, minimizing any loose portions of jersey that are particularly accessible to opponents. Typically, the upper portion of the jersey is heavily taped to underlying pads, in particular to shoulder pad assemblies, using two-sided adhesive tape.

The problems associated with taping athletic garments are numerous. For example, taping is a relatively slow and cumbersome process that often takes significant time. Football players, for example, may spend an hour or more having jerseys taped. Moreover, athletic or other tape used for this purpose is often not re-usable, creating wasted tape and added expense. Even when taped properly, taped jerseys and other garments are often uncomfortable due to pinching or binding of the tape or the garment itself, and the tape tends to fail due to wet conditions or from perspiration.

SUMMARY OF THE INVENTION

An athletic garment and pad system according to the present invention includes an athletic garment having at least one section of elastomeric raised loop fabric. The system also includes an athletic pad or pad assembly including at least one male hook substrate piece. The section of elastomeric raised loop fabric may be stretched and fixed to the male hood substrate piece to secure the garment to the athletic pad.

Utilization of the system according to the present invention reduces and in many cases eliminates the need for taping by providing a conjunctive or alternative method of securing the athletic garment.

DETAILED DESCRIPTION

Figure 1:
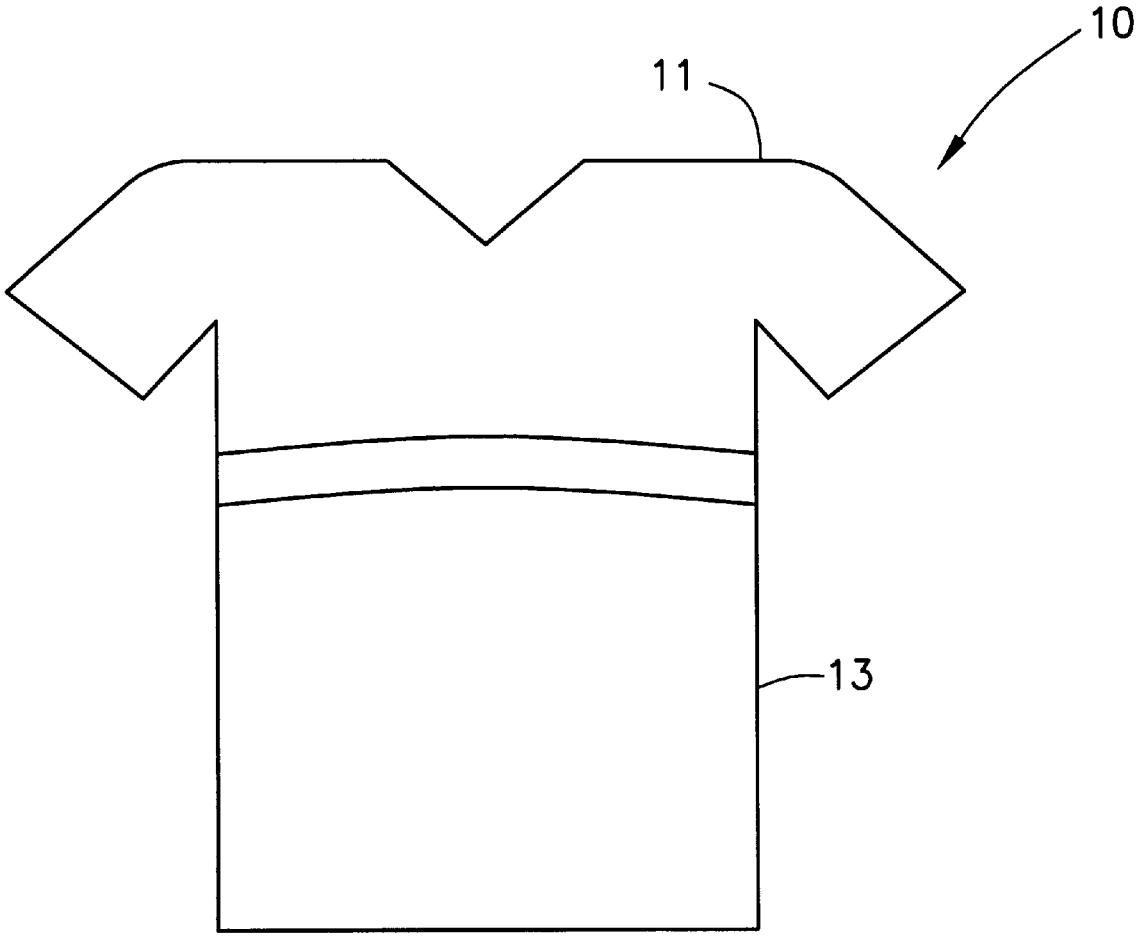
FIG. 1 is a side view of an exemplary embodiment of an athletic garment according to the present invention.
Figure 2:
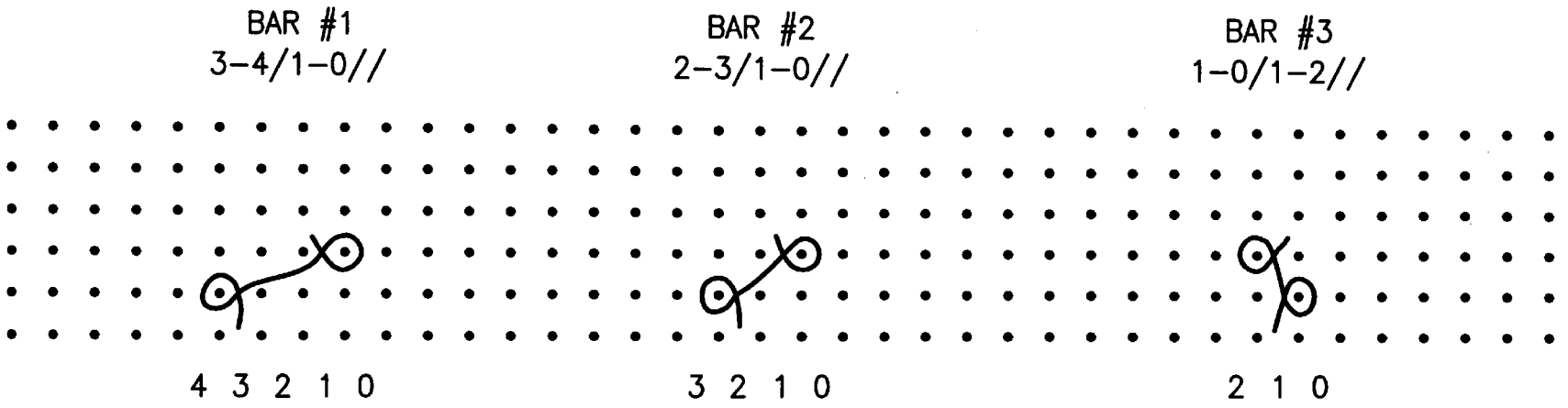
FIG. 2 is a stitch pattern of a preferred fabric for use in conjunction with the present invention.
Figure 3:
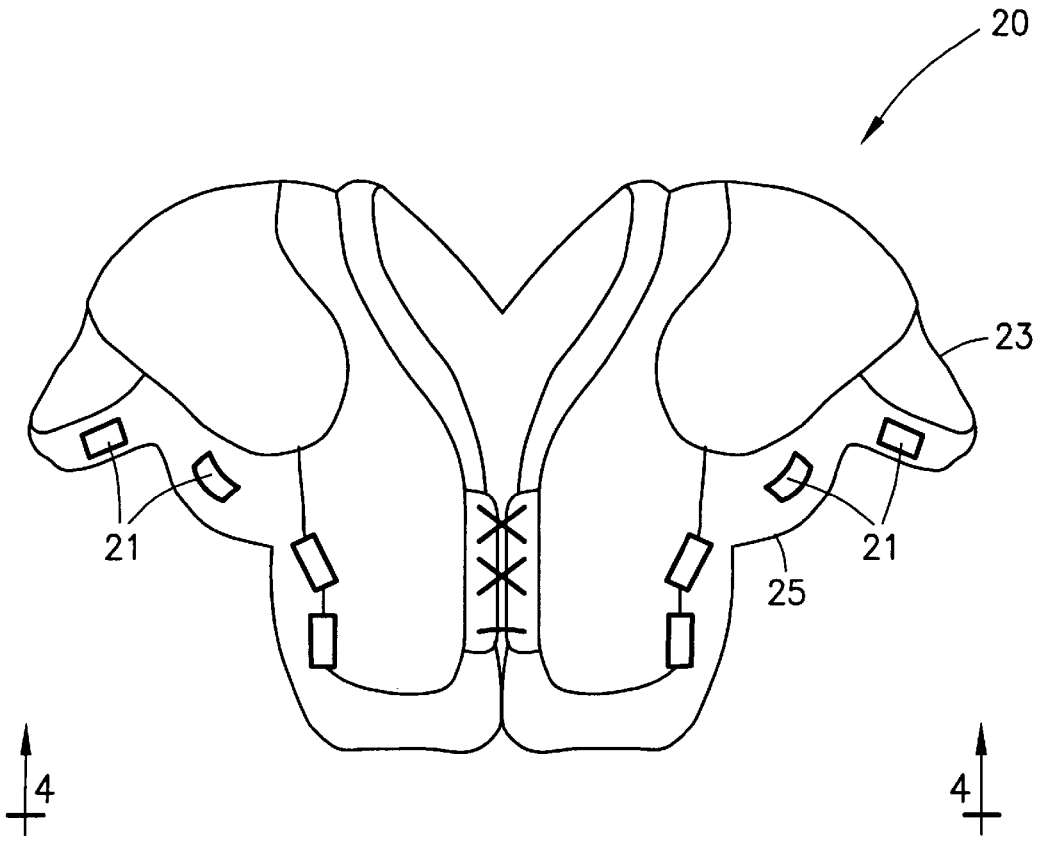
FIG. 3 is a side view of an exemplary embodiment of an athletic pad according to the present invention.

FIGS. 1 to 3 illustrate an exemplary athletic garment 10 and athletic pad 20 according to the present invention. In general, an athletic garment 10 according to the present invention includes at least one section of knitted elastomeric raised loop fabric, and preferably an upper portion of garment 10 is formed from elastomeric raised loop fabric. The elastomeric raised loop fabric forms the female portion of a hook and loop fastening system, and may be releasably fastened to a male portion or hook portion, generally referred to herein as "male hook substrate." Athletic pad 20 includes one or more pieces of male hook substrate, so that the elastomeric raised loop fabric may be stretched and fixed to the male hook substrate. In this manner, one or more loose portions or end portions of athletic garment 10 may be fixed relatively tightly to athletic pad 20, minimizing loose portions of the garment.

More particularly, FIG. 1 illustrates an exemplary embodiment of an athletic garment 10 according to the present invention. While the exemplary garment 10 is formed as a jersey useful for such sports as, for example, football, ice hockey or lacrosse, garment 10 generally includes any suitable type of athletic garment. Garment 10 includes at least one section 11 of elastomeric raised loop fabric, and preferably an upper portion is formed entirely of such a fabric, as illustrated in FIG. 1. The remainder of garment 10 not formed with the elastomeric raised loop fabric, such as lower portion 13 illustrated in FIG. 1, may be formed of any other suitable fabric. It is understood that if suitable, the entire garment 10 may be formed from the elastomeric raised loop fabric.

The elastomeric raised loop fabric used in conjunction with the present invention forms the female half of a hook and loop type fastener, so that section 11 of garment 10 may be stretched (if desired) and then fixed to a piece of male hook substrate. The male hook substrate forms the complementary other half of the hook and loop fastener. Preferably section 11 is formed of a multidirectional elastomeric fabric to facilitate stretching of the fabric in multiple directions.

FIG. 2 illustrates a stitch diagram for an exemplary elastomeric raised loop fabric or "stretch loop fabric" that is particularly suitable for use with the present invention. This preferred fabric is a knitted elastomeric fabric which may be formed on a warp knit tricot or raschel machine comprising at least three guide bars, each of which is preferably fully threaded.

The front guide bar knits a suitably robust heavy denier per filament "loop" yarn, for example a synthetic multifilament yarn (e.g., nylon) of between 4 and 12 filaments. Preferably each filament of this front yarn is between approximately 6 and approximately 20 denier. The front yarn may be knitted in a 1-0/3-4// needle lap or higher magnitude, or other suitable stitch. The middle guide bar knits a suitable ground yarn, for example a continuous synthetic filament ground yarn of approximately 150 denier or finer. This middle yarn may be knitted in a 2-3/1-0// stitch, or other suitable stitch. The back guide bar knits, for example, an elastomeric synthetic continuous filament yarn such as Spandex of between approximately 40 and approximately 240 denier. This back yarn may be knitted in a 1-0/1-2// stitch, or other suitable stitch. These preferred stitch patterns are illustrated in FIG. 2.

While the preferred elastomeric raised loop fabric is formed by knitting three yarns as described above, it should be understood that any suitable number of yarns may be employed. For example, the elastomeric raised loop fabric may be constructed from only two yarns. One such two-yarn construction may be achieved using the stitch patterns described above, but omitting the continuous synthetic ground yarn, so that only a front "loop" yarn and an elastomeric "back" yarn are provided.

In an exemplary manufacturing process, this knitted fabric then is further processed by pre-setting, beam dyeing, drying, and napping in a "raised unbroken loop." Preferably, napping the raised unbroken loop is accomplished with one or more passes over a multi-roll double action napper, having both pile and counter-pile worker rolls. As the fabric is passed over the worker rolls, wires on the surface of the rolls contact the fabric to raise and release, without breaking, the loop yarn (e.g., the robust heavy denier per filament loop yarn described above). The resulting fabric includes a plurality of raised, arched loops on the technical back of the fabric. After napping, the final product is then heat set, resulting in the female component of a hook and loop fastening system which has the added fabric features of stretch and recovery imparted by the elastomeric base yarn. While this fabric is preferably formed on a warp knit tricot or raschel knitting machine, it could also be produced by weft knitting, preferably using a plaited "3-end" or feed single fabric having a similar robust high denier per filament synthetic yarn floating on the technical back, and raised unbroken loop napping.

Figure 4:
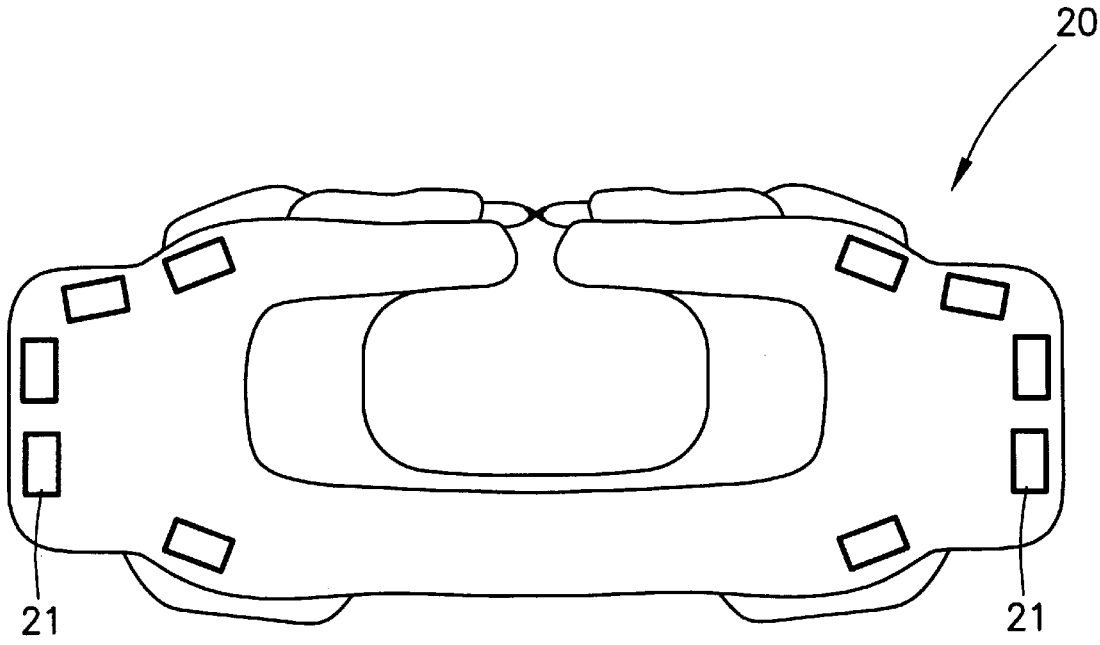
FIG. 4 is a bottom view of the athletic pad of FIG. 2, taken along line 4—4 of FIG. 3.

FIGS. 3 and 4 illustrates an exemplary athletic pad 20 according to the present invention. While the illustrated athletic pad 20 includes a football shoulder pad assembly, any suitable pad or pad assembly may be used in conjunction with the present invention. Moreover, the term "pad" should be read to include other types of athletic equipment useful under, over, or adjacent to athletic garments, for example athletic braces or supports.

Athletic pad 20 includes at least one male hook substrate piece 21, and preferably includes a plurality of male hook substrate pieces 21. Any suitable male hook substrate piece 21 may be provided, but preferably male hook substrate pieces 21 are formed as a cut monofilament woven loop substrate, which allows for multiple opening and closing cycles while minimizing rupturing or destruction of the elastomeric raised loop fabric. In a preferred embodiment, male hook substrate pieces 21 are formed separate from athletic pad 20 and then permanently attached to athletic pad 20. However, any suitable construction or manufacturing process may be employed. For example, male hook substrate pieces 21 can be releasably attached to athletic pad 20. Alternatively, for example, male hook substrate pieces 21 can be formed integrally with athletic pad 20.

As illustrated in FIGS. 3 and 4, male hook substrate pieces 21 are preferably arranged around and underneath a sleeve area 23 and a pectoral area 25. For football athletes, for example, this arrangement of male hook substrate pieces 21 allows an athletic garment 10 (e.g., a football jersey) having section 11 of elastomeric raised loop fabric to be stretched over athletic pad 20. Section 11 may then be fixed to male hook substrate piece 21 to retain garment 10 in its stretched position, minimizing any loose folds or pieces of garment 10. While the general arrangement of male hook substrate pieces 21 illustrated in FIGS. 3 and 4 is preferred, any suitable arrangement of one or more male hook substrate pieces 21 may be provided.

The athletic garment and pad according to the present invention have been described with respect to several exemplary embodiments. It can be understood, however, that there are many other variations of the above-described embodiments which will be apparent to those skilled in the art, even where elements have not explicitly been designated as exemplary. For example, the elastomeric raised loop fabric could include additional yarns or different types of yarns to achieve a variety of performance parameters. It is understood that this and other modifications are within the teaching of the present invention, which is to be limited only by the claims appended hereto.

What is claimed is:

1. An athletic garment and equipment system, comprising:

an athletic garment including at least one section of knitted elastomeric raised loop fabric, the elastomeric raised loop fabric being formed of at least a first yarn, a second yarn, and a third yarn, wherein the first yarn is a multifilament yarn, the second yarn is a synthetic filament yarn, and the third yarn is an elastomeric continuous filament yarn; and an athletic pad comprising a football shoulder pad assembly and including at least one male hook substrate piece.

2. The system according to claim 1, wherein the first yarn is a synthetic multifilament yarn of between approximately 6 and approximately 20 denier per filament, the second yarn is less than approximately 150 denier, and the third yarn is between approximately 40 and approximately 240 denier.

3. The system according to claim 1, wherein the at least one male hook substrate piece is formed of a cut monofilament woven loop substrate.

4. The system according to claim 3, wherein the first yarn is a synthetic multifilament yarn of between approximately 6 and approximately 20 denier per filament, the second yarn is less than approximately 150 denier, and the third yarn is between approximately 40 and approximately 240 denier.

5. An athletic jersey and equipment system, comprising:

an athletic jersey including an upper portion, the upper portion being formed of knitted elastomeric raised loop fabric; and an athletic pad assembly, the athletic pad assembly comprising a football shoulder pad assembly and including a plurality of male hook substrate.

6. The system according to claim 5, wherein the elastomeric raised loop fabric is formed of at least a first yarn, a second yarn, and a third yarn, wherein the first yarn is a multifilament yarn, the second yarn is a synthetic filament yarn, and the third yarn is an elastomeric continuous filament yarn.

7. The system according to claim 6, wherein the first yarn is a synthetic multifilament yarn of between approximately 6 and approximately 20 denier per filament, the second yarn is less than approximately 150 denier, and the third yarn is between approximately 40 and approximately 240 denier.

8. The system according to claim 5, wherein the plurality of male hook substrate pieces are formed of a cut monofilament woven loop substrate.

9. The system according to claim 8, wherein the elastomeric raised loop fabric is formed of at least a first yarn, a second yarn, and a third yarn, wherein the first yarn is a multifilament yarn, the second yarn is a synthetic filament yarn, and the third yarn is an elastomeric continuous filament yarn.

10. The system according to claim 9, wherein the first yarn is a synthetic multifilament yarn of between approximately 6 and approximately 20 denier per filament, the second yarn is less than approximately 150 denier, and the third yarn is between approximately 40 and approximately 240 denier.

11. A method of applying an athletic garment and athletic pad system, comprising:

providing an athletic garment including at least one section of elastomeric raised loop fabric;

providing an athletic pad comprising a football shoulder pad assembly and including at least one male hook substrate piece;

applying the athletic pad to an athlete;

applying the athletic garment to the athlete; and affixing the at least one section of elastomeric raised loop fabric to the at least one male hook substrate piece.

12. The method according to claim 11, wherein the elastomeric raised loop fabric is a knitted fabric.

13. The method according to claim 12, wherein the elastomeric raised loop fabric is formed of at least a first yarn, a second yarn, and a third yarn, wherein the first yarn is a multifilament yarn, the second yarn is a synthetic filament yarn, and the third yarn is an elastomeric continuous filament yarn.

14. The method according to claim 13, wherein the first yarn is a synthetic multifilament yarn of between approximately 6 and approximately 20 denier per filament, the second yarn is less than approximately 150 denier, and the third yarn is between approximately 40 and approximately 240 denier.

15. The method according to claim 11, wherein the athletic garment is a football jersey and the athletic pad includes a football shoulder pad assembly.

16. The method according to claim 15, wherein the at least one section of elastomeric rased loop fabric includes an upper portion of the football jersey, wherein the football shoulder pad assembly includes a plurality of male hoop substrate pieces, and wherein the step of affixing includes stretching the upper portion of the football jersey and affixing the upper portion of the football jersey to the plurality of male hoop substrate pieces.

17. The method according to claim 16, wherein the elastomeric raised loop fabric is a knitted fabric.

18. The method according to claim 17, wherein the elastomeric raised loop fabric is formed of at least a first yarn, a second yarn, and a third yarn, wherein the first yarn is a multifilament yarn, the second yarn is a synthetic filament yarn, and the third yarn is an elastomeric continuous filament yarn.

19. The method according to claim 18, wherein the first yarn is a synthetic multifilament yarn of between approximately 6 and approximately 20 denier per filament, the second yarn is less than approximately 150 denier, and the third yarn is between approximately 40 and approximately 240 denier.

20. The method according to claim 19, wherein the plurality of male hook substrate pieces are formed of a cut monofilament woven loop substrate.

21. An athletic garment and equipment system, comprising:

an athletic garment including at least one section of knitted elastomeric raised loop fabric, the elastomeric raised loop fabric being formed of at least a front yarn and a back yarn, wherein front yarn is a multifilament yarn and the back yarn is an elastomeric continuous filament yarn; and an athletic pad including comprising a football shoulder pad assembly and at least one male hook substrate piece.

22. The system according to claim 21, wherein the front yarn is a synthetic multifilament yarn of between approximately 6 and approximately 20 denier per filament and the back yarn is between approximately 40 and approximately 240 denier.

23. The system according to claim 21, wherein the at least one male hook substrate piece is formed of a cut monofilament woven loop substrate.

24. The system according to claim 23, wherein the front yarn is a synthetic multifilament yarn of between approximately 6 and approximately 20 denier per filament and the back yarn is between approximately 40 and approximately 240 denier.

* * * * *